US006725873B2

(12) United States Patent
Liu

(10) Patent No.: US 6,725,873 B2
(45) Date of Patent: Apr. 27, 2004

(54) FOLDABLE TENT FRAME

(76) Inventor: Fu-Tien Liu, P.O. Box 6-57, Chung-Ho, Taipei 235 (TW)

( * ) Notice: Subject to any disclaimer, the term of this patent is extended or adjusted under 35 U.S.C. 154(b) by 20 days.

(21) Appl. No.: 10/108,498

(22) Filed: Mar. 29, 2002

(65) Prior Publication Data

US 2003/0183265 A1 Oct. 2, 2003

(51) Int. Cl.[7] ..... E04H 15/50
(52) U.S. Cl. ..... 135/145; 135/159; 135/131
(58) Field of Search ..... 135/131, 144, 135/145, 147, 158, 159, 160

(56) References Cited

U.S. PATENT DOCUMENTS 1,204,329 A * 11/1916 Wilkens
4,779,635 A * 10/1988 Lynch ..... 135/97
5,421,356 A * 6/1995 Lynch ..... 135/145
5,490,532 A * 2/1996 Mallookis et al. ..... 135/117
5,638,853 A * 6/1997 Tsai ..... 153/145
5,701,923 A * 12/1997 Losi, Jr. et al. ..... 15/131
5,944,040 A * 8/1999 Jang ..... 135/126
6,000,175 A * 12/1999 Gale et al. ..... 52/63
6,035,877 A * 3/2000 Losi, Jr. et al. ..... 135/131
6,173,726 B1 * 1/2001 Talmadge ..... 135/144
6,283,136 B1 * 9/2001 Chen ..... 135/144
6,374,843 B1 * 4/2002 Zou ..... 135/145
6,382,224 B1 * 5/2002 Carter ..... 135/145

* cited by examiner

*Primary Examiner*—Robert Canfield
(74) *Attorney, Agent, or Firm*—Troxell Law Office PLLC

(57) ABSTRACT

A tent frame structure includes an upright pole with a lower nest movably inserted thereon and an upper nest fixed at the upper end thereof; one end of a large supporting rod is pivotally jointed with the upper nest and the other end thereof is pivotally jointed with a small supporting rod; the other end of the small supporting rod is pivotally jointed unto a top nest; one end of a supporting strut is pivotally jointed with the midsection of the large supporting rod and the other end thereof is pivotally jointed unto the lower nest; a plurality of struts respectively joint two adjacent upper and lower nests; the jointed struts cross and hinge each other to compose a movable and foldable frame in a shape of a parallelogram; to merely slide the lower nest up and down enables the opening and folding of the tent.

10 Claims, 7 Drawing Sheets

FOLDABLE TENT FRAME

BACKGROUND OF THE INVENTION

1) Field of the Invention

The present invention relates to a tent frame structure, more especially to a foldable tent frame structure.

2) Description of the Prior Art

Accordingly, in the modern life, tents have been extensively applied to provide temporary shelters for people having an outing, a picnic or engaging other outdoor activities. There are two kinds of structures available on the market, one is assemble-type that requires all the tent frames to be assembled before the tent cloth is covered thereon and fastened for use; the assembly and dismounting of this kind of tent is very troublesome; the frames are piecemeal and hard for carrying. The other kind belongs to a foldable type with all the tent frames jointed into one unit to be folded for storage; the installation and detachment thereof is more convenient; however, since the top tent frames of most of the foldable tents adopt the space truss structure, the entire weight of the foldable tent is heavier and not very convenient for carrying; moreover, the complicated structure of a space truss does not provide stable top tent frames for this kind of foldable tent; it swings as the wind blows toward its direction. Some of the top tent frames are a detachable cross beam; a cross beam structure reduces the difficulty in installation, but the width and the length of he dismounted cross beam occupy a considerable space in transportation and that causes more problems in carrying; those drawbacks of the prior art need to be improved.

SUMMARY OF THE INVENTION

The present invention tends to improve the shortcomings of the abovementioned tent and is implemented by movably inserting a lower nest unto an upright pole; the upper end of the upright pole is fixedly jointed with an upper nest; one end of a large supporting rod is pivotally jointed with the upper nest and the other end thereof is pivotally jointed with a small supporting rod; the other end of the small supporting rod is pivotally jointed unto a top nest; one end of a supporting strut is pivotally jointed with the midsection of the large supporting rod and the other end thereof is pivotally jointed unto the lower nest; a plurality of struts respectively connect two adjacent upper and lower nests; the connected struts cross and hinge each other to compose a movable and foldable frame in a shape of a parallelogram; a receiving slot is disposed on the end pivotally jointing the large supporting rod and the small supporting rod to match with the pivotal joint portion of the small supporting rod; the pivotal joint portion of the small supporting rod and the small supporting rod can be either manufactured unitarily or separately then connected to one unit; the folded small and large supporting rods define a gap to cooperate the folding of the tent cloth; the large supporting rod, the small supporting rod and the supporting strut can be manufactured as solid or hollow rod bodies in various shapes.

The said upright pole can be manufactured as an expansive pole body in two or multiple segments; the upper end plane of the upper next is an inclined plane; a plurality of pivotal joint slots are disposed on the upper nest to pivotally joint with the large supporting rod and the strut for manufacturing tent frames in various shapes.

To adopt this kind of structure merely needs to slide the lower nest up and down to use the consecutive movement among the large and small supporting rods, the supporting strut and strut for opening and folding the tent frame; the application is convenient and the volume of the folded tent frame is small for easy carrying.

The objective of the present invention is to provide a foldable tent frame convenient for installation and detachment; in addition, the volume of the folded tent frame is small for easy carrying To enable a further understanding of the objective, features and functions of the present invention, the brief description of the drawings below is followed by the detailed description of the preferred embodiment.

DETAILED DESCRIPTION OF THE PREFERRED EMBODIMENTS

Figure 1:
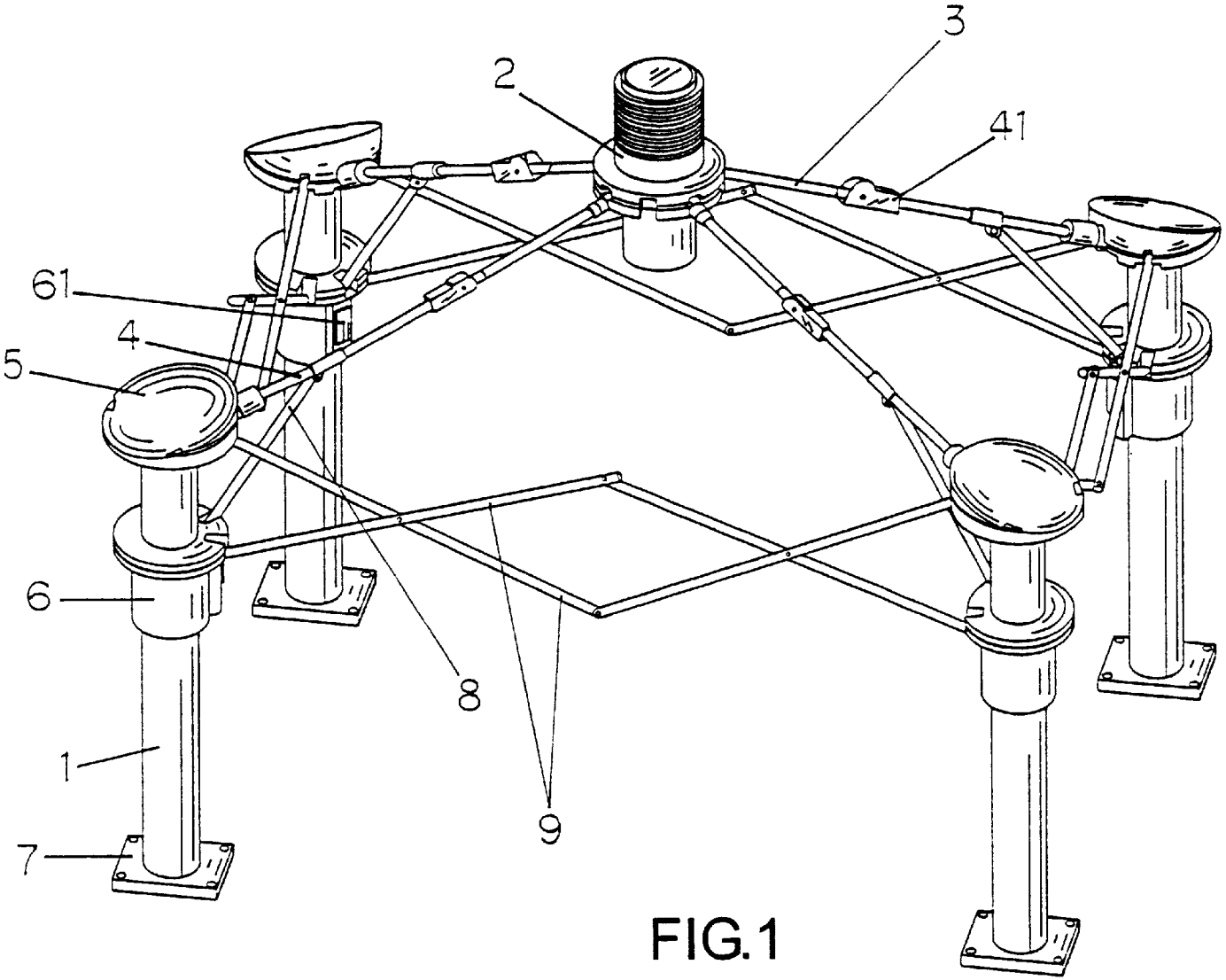
FIG. 1 is a schematic drawing of the structure of the opened present invention.
Figure 2:
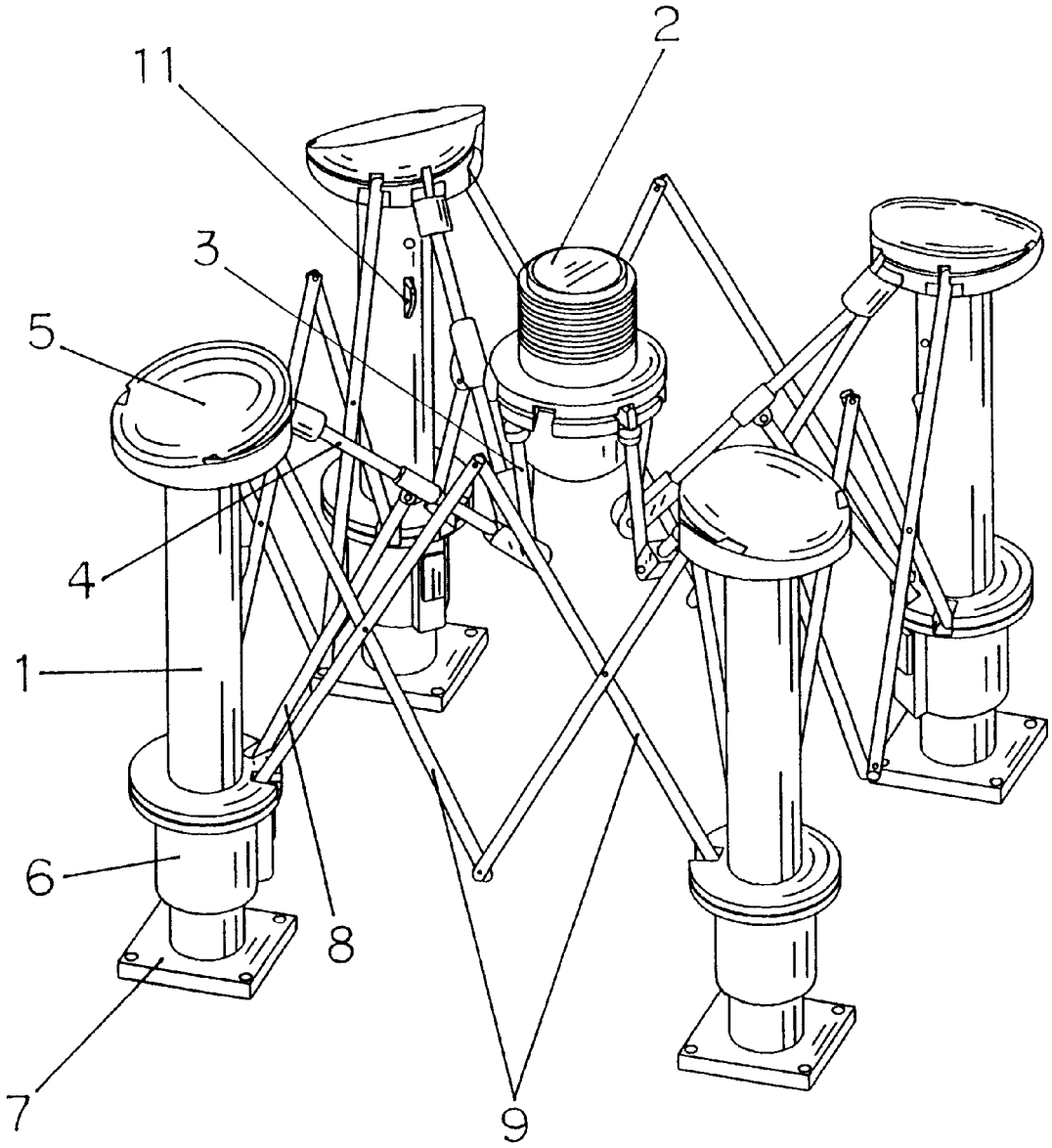
FIG. 2 is a schematic drawing of the present invention opened half way.
Figure 3:
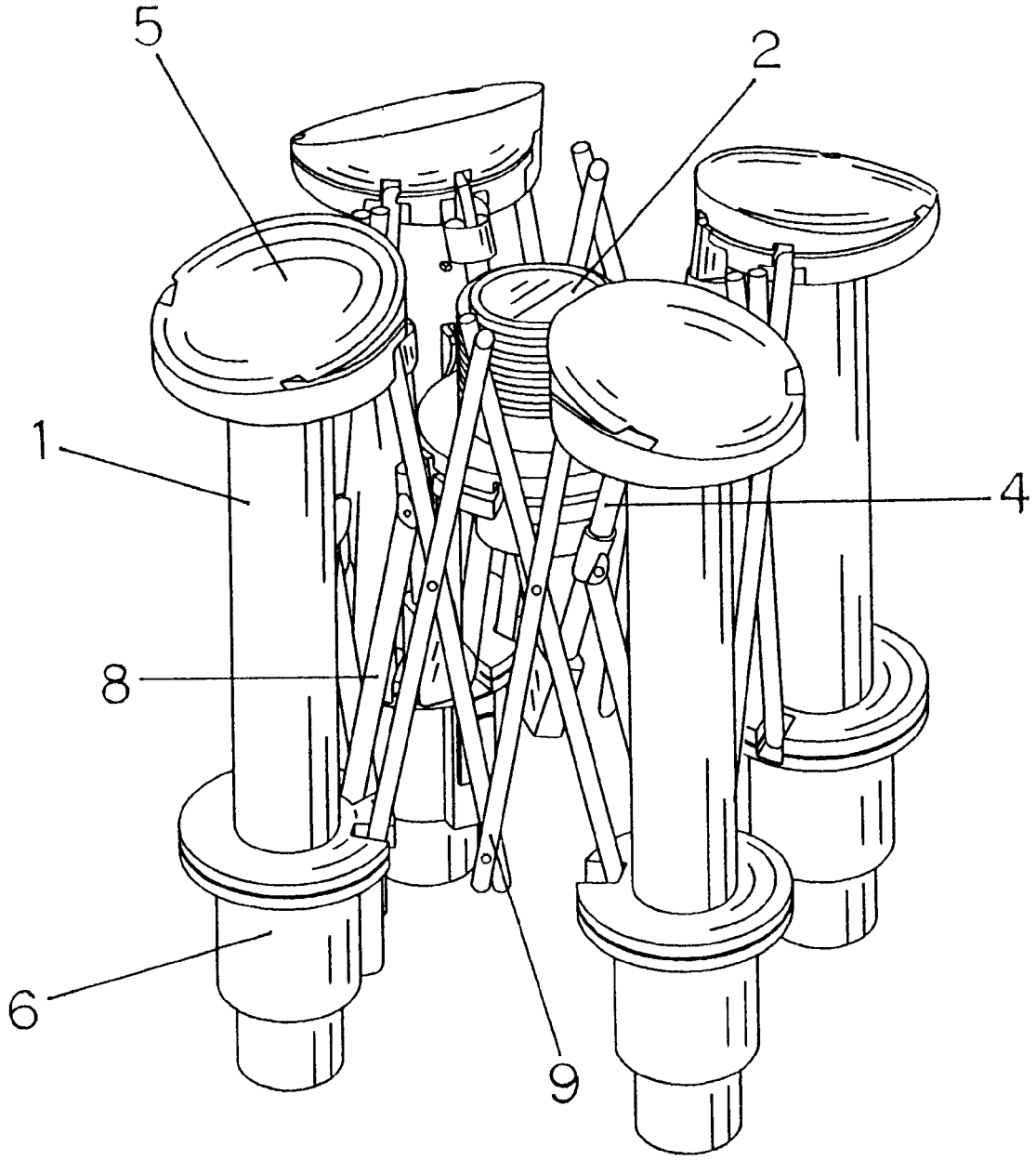
FIG. 3 is a schematic drawing of the present invention folded completely.
Figure 4:
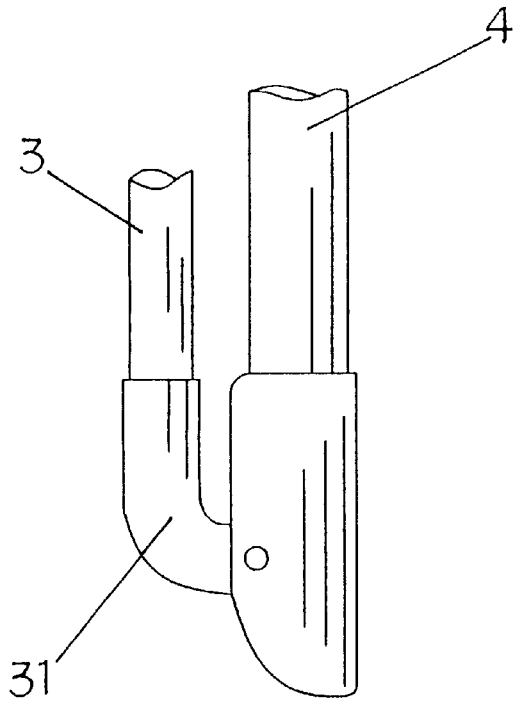
FIG. 4 is a schematic drawing of the folded large and small supporting rods.
Figure 5:
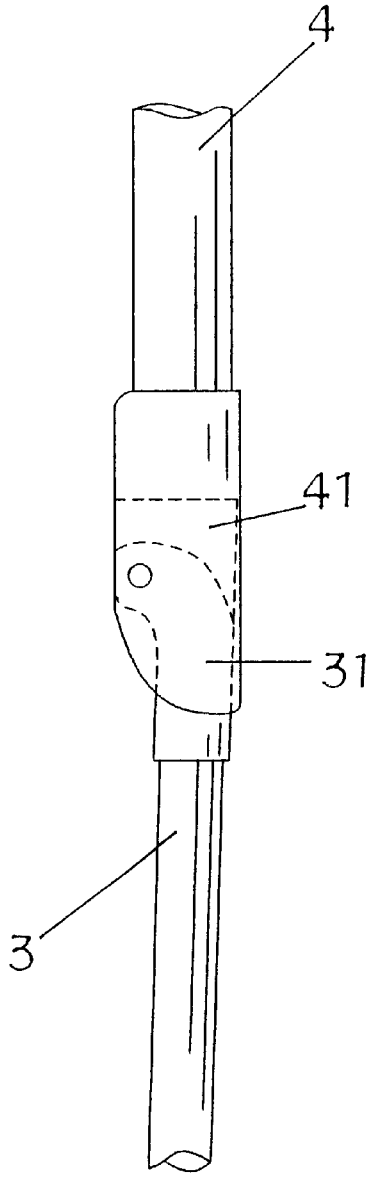
FIG. 5 is a schematic drawing of the completely opened large and small supporting rods.

Referring to FIGS. 1 to 5, the present invention comprises a plurality of upright poles (1), a top nest (2), a plurality of small supporting rods (3), large supporting rods (4), upper nests (5) and lower nests (6); wherein the lower end of the upright pole (1) joints with a fixed base (7); the lower nest (6) is movably inserted onto the upright pole (1); the upper end of the upright pole (1) fixedly joints with the upper nest (5); one end of the large supporting rod (4) also pivotally joints with the upper nest (5) and the other end thereof is disposed with a receiving slot (41) to match and pivotally joint with the pivotal joint portion (31) of the small supporting rod (3); the other end of the small supporting rod (3) pivotally joints unto the top nest (2); one end of the supporting strut (8) pivotally joints with the midsection of the large supporting rod (4) and the other end thereof pivotally joints onto the lower nest (6); a plurality of struts (9) respectively connect the adjacent upper nest (5) and the lower nest (6); the struts (9) cross and hinge each other to form a movable and foldable frame in a shape of a parallelogram.

When in use, the lower nest (6) of the present invention is pushed upwards to make the supporting strut (8) and the strut (9) jointed onto the lower nest (6) expand outwardly; one end of the supporting strut (8) works the large supporting rod (4) to make its pivotal jointing point around the upper nest (5) push and expand upwards; the upward movement of the other end of the large supporting rod (4) works the small supporting rod (3) to make its other end prop up the top nest (2) till the small supporting rod (3) and the large supporting rod (4) expand to the same axial line; at the mean time, the retaining slot inside the lower nest (6) clips the retaining hook (11) on the upright pole (1) for retaining the lower nest (6) to prevent its downward sliding and further support the large supporting rod (4) so as to prop up the entire tent frame; while the strut (9) is expanding outwardly, a plurality of hinged struts (9) work each other to change the parallelogram shape for propping up the adjacent upright pole (1) to make the tent frame expand into a square shape; finally, through the fixed base (7) at the lower end of the upright pole (1), every upright pole (1) is fixed to stand on the ground or at other proper position so as to accomplish the tent installation; to detach the tent after usage, fastening nails on the fixed base (7) are first dismounted, then the press button (61) on the lower nest is pressed down to withdraw the retaining hook (11) on the upright pole (1) from the retaining slot of the lower nest (6) to pull the lower nest (6) to slide down the upright pole (1); at the same time, the supporting strut (8) pivotally jointed on the lower nest (6) also pulls the large supporting rod (4) to fold downwards toward the upright pole (1); the external end of the large supporting rod (4) works the small supporting rod (3) to make it move downwardly and fold toward the large supporting rod (4) at the same time; the other end of the small rod (3) correspondingly moves the top nest (2) downwardly till four upright poles (1) enclose it around; the folded small and large supporting rod (3, 4) define a gap for accommodating a tent cloth and that prevents the tent frame from failing to fold completely or the tent cloth from being damaged by pressing or scratching during folding; while the lower nest (6) is moving downwardly, the parallelogram shape composed by the strut (9) changes into a folded shape to achieve the objective of expanding and folding; therefore, the tent is folded into a bundle convenient for carrying.

Figure 6:
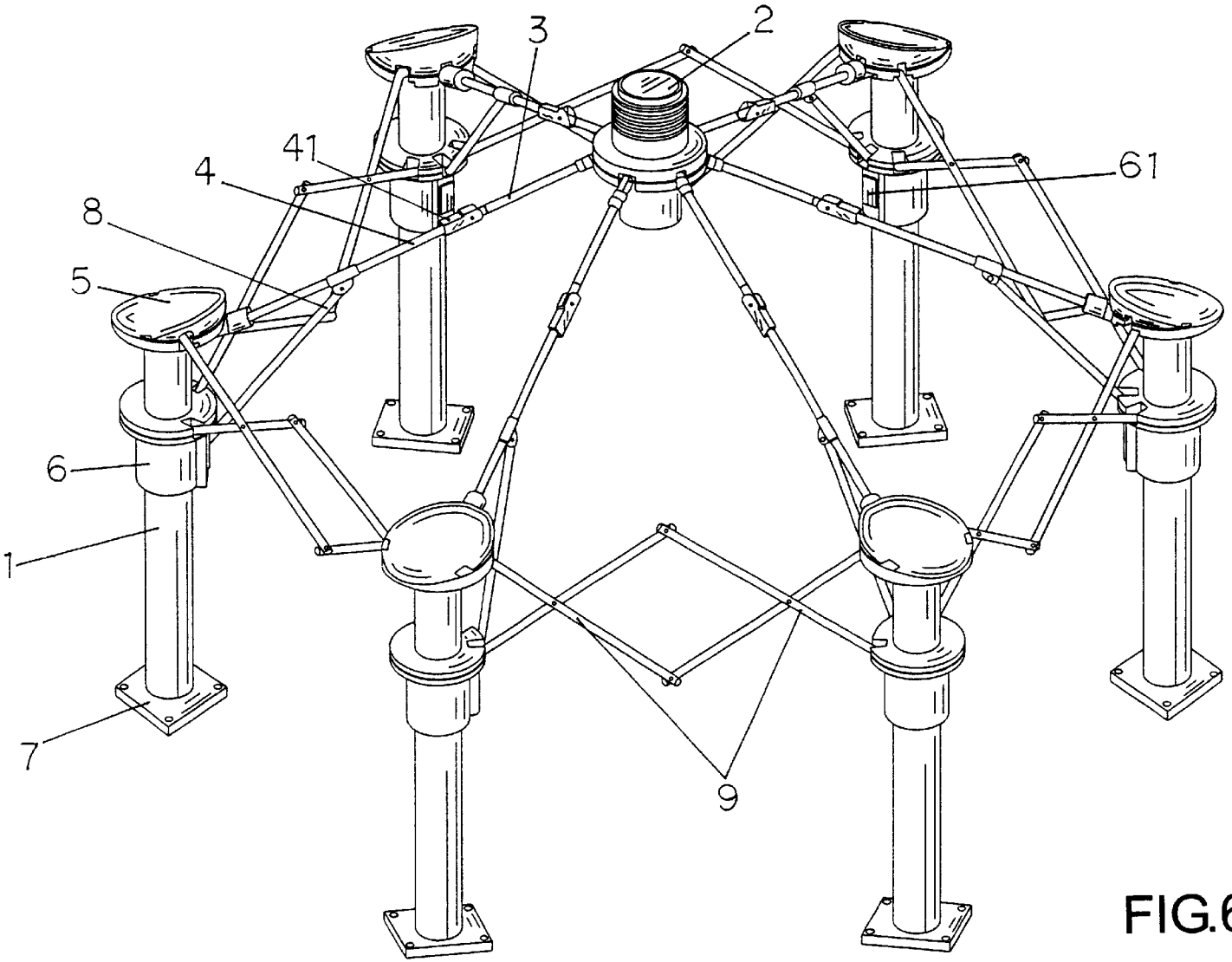
FIG. 6 is a schematic drawing of the present invention in another state.
Figure 7:
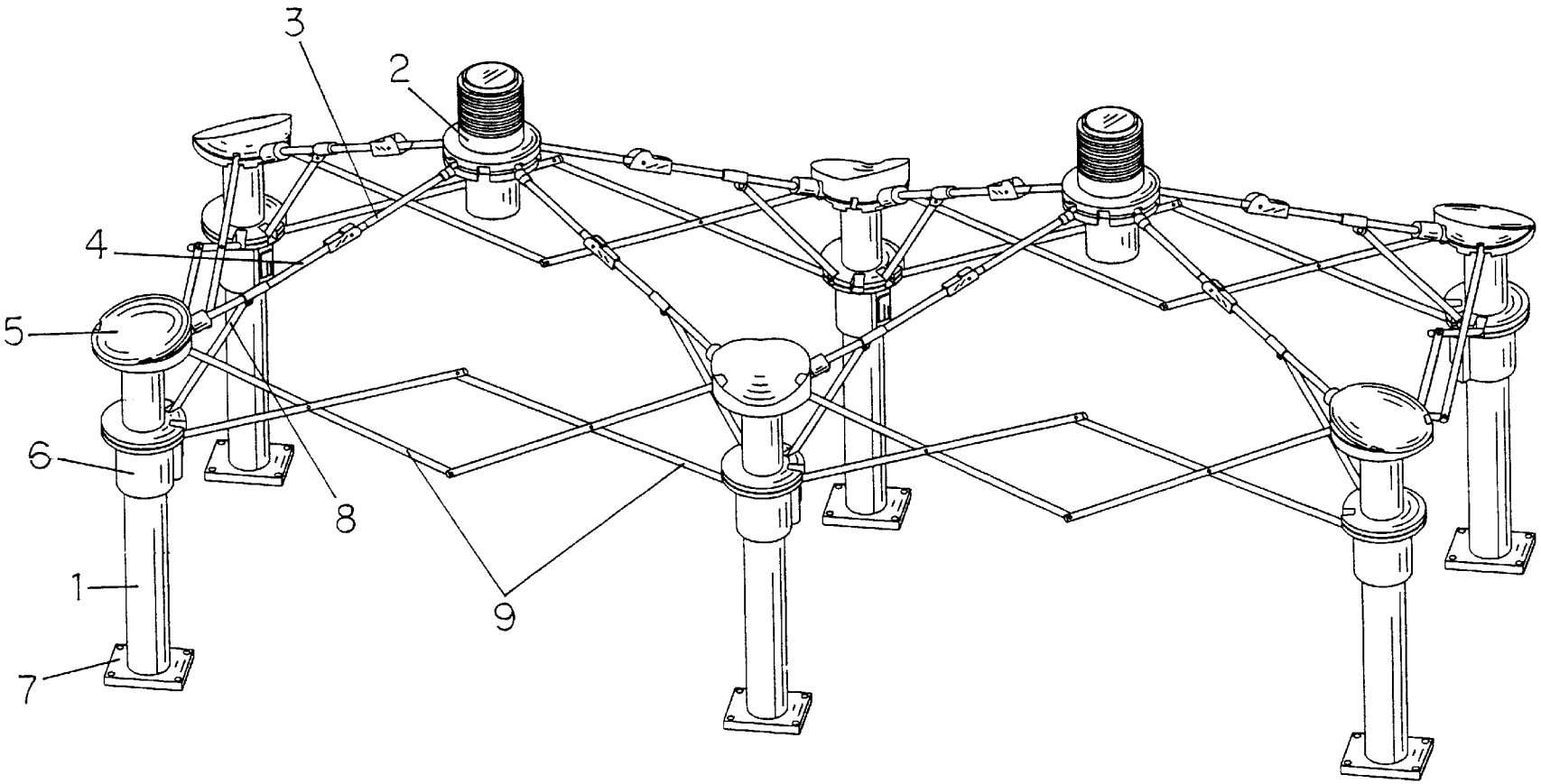
FIG. 7 is a schematic drawing of the present invention in yet another state.
Figure 8:
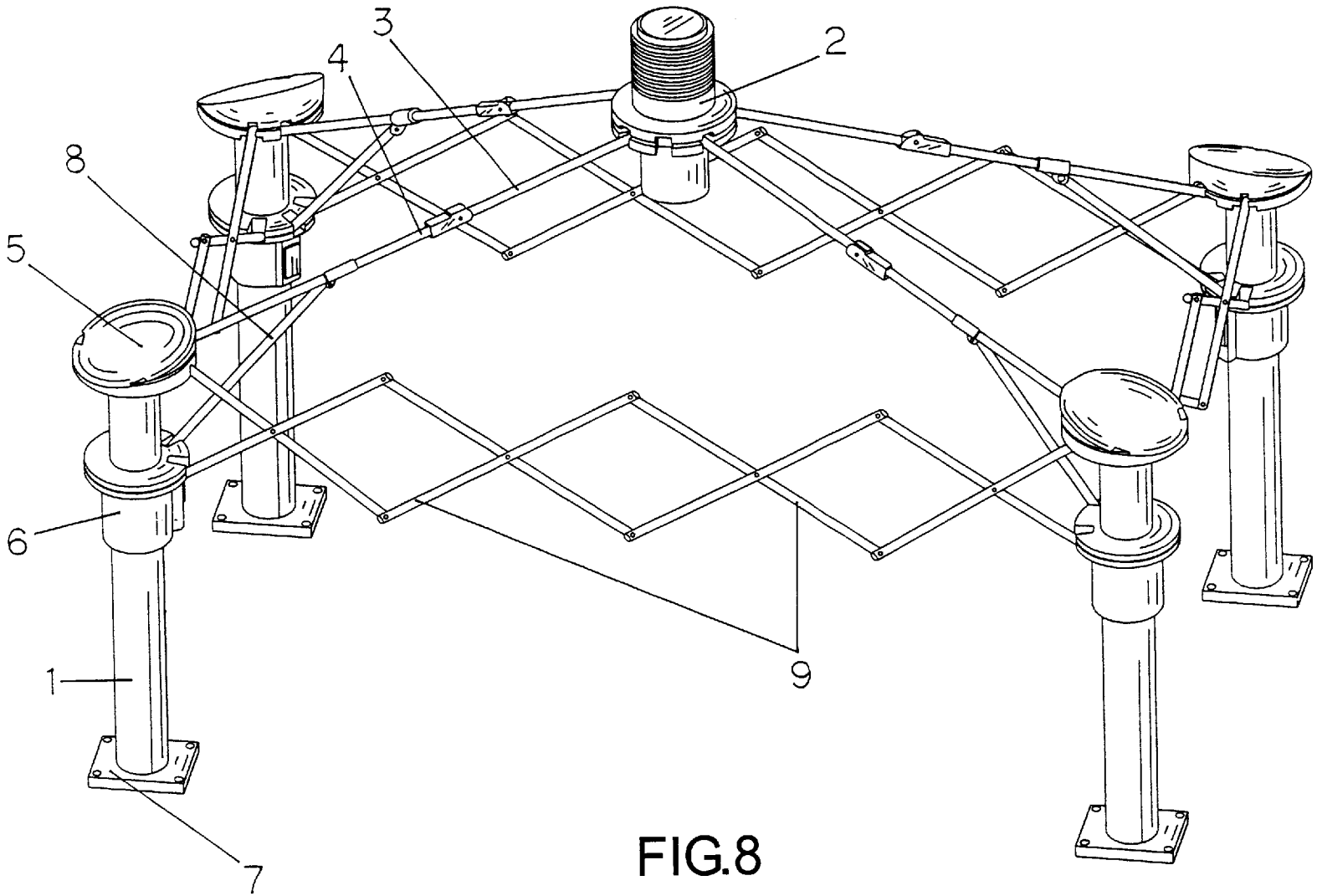
FIG. 8 is a schematic drawing of the present invention in still another state.

Referring to FIGS. 6, 7 and 8, the present invention can be manufactured as a shape of hexagon, rectangle or any polygons to meet consumers' various demands.

In summation of the abovementioned, the foldable tent frame of the present invention is indeed capable of increasing the convenient and practical effect. It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A foldable tent frame comprising:

a) a plurality of poles, each of the plurality of poles having:

i) an upper nest with a circular top surface located on an upper end of each of the plurality of poles, the circular top surface being an inclined plane; and ii) a lower nest slidably positioned on an outer circumference of each of the plurality of poles;

b) at least one top nest;

c) a plurality of first support rods, each of the plurality of first support rods having a middle section between a first end and a second end and being pivotally connected at the first end to the upper nest on one of the plurality of poles;

d) a plurality of second support rods, each of the plurality of second support rods being pivotally connected at a first end to the at least one top nest and pivotally connected at a second end to the second end of one of the plurality of first support rods;

e) a plurality of supporting struts, each of the plurality of supporting struts being pivotally connected at a first end to the lower nest and pivotally connected at a second end to the middle section of one of the plurality of first support rods on and f) a plurality of sets of struts, each of the plurality of sets of struts includes a plurality of intersecting struts pivotally hinged at intersections and pivotally connected to the upper nest and lower nest of two adjacent poles of the plurality of poles to define an outer periphery of the foldable tent frame, where in the plurality of poles, the plurality of first support rods, the plurality of second support rods, and the plurality of struts are movable between a folded position when the lower nest on each of the plurality of poles is slid downward and an opened position when the lower nest on each of the plurality of poles is slid upward.

2. The foldable tent frame according to claim 1, further comprising a plurality of fixed bases, one fixed base being connected to a lower end of each of the plurality of poles.

3. The foldable tent frame according to claim 1, further comprising a receiving slot on the second end of each of the plurality of first support rods, and a pivotal joint portion on the second end of each of the plurality of second support rods, the pivotal joint portion and the receiving slot being pivotally connected.

4. The foldable tent frame according to claim 1, wherein the plurality of first support rods and the plurality of second support rods are spaced apart in the folded position, such that a tent cloth is positioned therebetween.

5. The foldable tent frame according to claim 1, wherein each of the plurality of poles is a telescopic pole body having at least two sections.

6. The foldable tent frame according to claim 1, wherein the plurality of first support rods, the plurality of second support rods, and the plurality of struts are selected from the group consisting of solid and hollow rod bodies.

7. The foldable tent frame according to claim 1, further comprising a plurality of retaining hooks, one retaining hook being connected to each of the plurality of poles and removably engaging the lower nest on to secure the lower nest in the opened position.

8. The foldable tent frame according to claim 1, wherein the plurality of poles includes four poles.

9. The foldable tent frame according to claim 1, wherein the plurality of poles includes six poles.

10. The foldable tent frame according to claim 9, wherein the at least one top nest includes two top nests.

* * * * *